US005867969A

United States Patent [19]

Quinones

[11] Patent Number: 5,867,969

[45] Date of Patent: Feb. 9, 1999

[54] METHOD FOR WRAPPING STEEL

[76] Inventor: Victor Manuel Quinones, 7123 Horizon Peak, San Antonio, Tex. 78233

[21] Appl. No.: 868,263

[22] Filed: Jun. 3, 1997

Related U.S. Application Data

[63] Continuation-in-part of Ser. No. 540,457, Oct. 10, 1995, Pat. No. 5,657,613.

[51] Int. Cl.[6] ..... B65B 5/04

[52] U.S. Cl. ..... 53/469; 53/409; 53/414

[58] Field of Search ..... 53/138.7, 139.4, 53/204, 284.7, 409, 414, 469; 383/74, 75, 76; 206/397, 398, 400, 407, 410, 415, 416

[56] References Cited

U.S. PATENT DOCUMENTS

| | | | |
|---|---|---|---|
| 737,328 | 8/1903 | Boyle et al. . | |
| 744,467 | 11/1903 | Boyle et al. . | |
| 746,447 | 12/1903 | Boyle et al. . | |
| 1,748,087 | 2/1930 | Spanel | 383/75 X |
| 3,670,877 | 6/1972 | Reed | 53/409 X |
| 3,690,087 | 9/1972 | Jacobsen . | |
| 3,789,897 | 2/1974 | Saito | 383/75 X |
| 3,856,141 | 12/1974 | Reed | 53/409 X |
| 3,902,541 | 9/1975 | Wardwell | 383/76 X |
| 3,915,301 | 10/1975 | Gray et al. | 206/409 |
| 3,942,638 | 3/1976 | Stone | 53/415 X |
| 4,513,864 | 4/1985 | Liebel | 206/396 |
| 4,524,562 | 6/1985 | Yagi et al. | 53/409 |
| 4,826,015 | 5/1989 | Mandel . | |
| 4,928,454 | 5/1990 | Bertolotti | 53/409 |
| 4,957,246 | 9/1990 | Kantor | 206/410 X |
| 5,238,307 | 8/1993 | Mooney et al. | 383/74 |
| 5,456,062 | 10/1995 | Wechsler | 53/414 X |

FOREIGN PATENT DOCUMENTS

| | | |
|---|---|---|
| 3-29764 | 2/1991 | Japan . |

*Primary Examiner*—Daniel B. Moon
*Attorney, Agent, or Firm*—Richard C. Litman

[57] ABSTRACT

A method for wrapping coiled material which includes the selection of a tear-resistant bag having openings at either end and drawstrings near each opening. A roll of steel is lifted, e.g., by a forklift, and the bag is slipped over the roll of steel. The excess material of the bag is then folded over so that the bag tightly fits the steel roll. The strings are then drawn tightly, pulling the bag radially over the steel roll such that the ends of the bag overlaps the aperture of the core of the roll. The overlapping portions of the bag are folded inside of the core of the coiled material and inner diameter protectors are placed in the core to secure the bag.

6 Claims, 6 Drawing Sheets

METHOD FOR WRAPPING STEEL

This application is a Continuation-In-Part of application Ser. No. 08/540,457, filed Oct. 10, 1995 now U.S. Pat. No. 5,657,613.

BACKGROUND OF THE INVENTION

1. Field of the Invention

The present invention relates to a method for wrapping rolled material, particularly a roll of steel.

2. Description of Related Art

In the manufacturing of steel rolls it is desirable to encase the roll to provide protection of the roll during shipping and storage. Heretofore, methods and systems for wrapping rolled material and cable are slow and do not provide moisture resistance in that they do not completely cover the roll. Further, in order to cover the rolls, it has been necessary to manipulate the heavy rolls, a hazardous and disagreeable task.

Following are previously patented inventions which disclose related inventions having the above-noted limitations.

U.S. Pat. Nos. 737,328, 744,467, and 746,447, issued to H. C. Boyle et al. on Aug. 25, 1903, Nov. 17, 1903, and on Dec. 8, 1903, respectively, teach tubular covers for wire coils which are tightened over the coil and whose free ends are held together by laces, straps, or buckles.

U.S. Pat. No. 3,690,087, issued on Sep. 12, 1972 to Arnulv Moe Jacobsen, teaches a method of packaging cable in which two flexible members are attached to a mandrel on which a cable has been wound and attached to each other by rope laced through holes in flaps around the periphery of the flexible members.

U.S. Pat. No. 4,826,015, issued on May 2, 1989 to Ronald L. Mandel, teaches a material handling arrangement which includes a set of straps circumferentially wrapping a roll of material and a second set radially wrapped around the material.

Japanese patent 3-29764, issued on Feb. 7, 1991, to Susumi Minato, teaches a method of wrapping coiled material by wrapping an outer cover around the coil and tightening with drawstrings.

In addition to lacking many of the benefits of the instant invention, these patents teach methods completely different from that instantly claimed. Thus, none of the above inventions and patents, taken either singly or in combination, is seen to describe the instant invention as claimed.

SUMMARY OF THE INVENTION

The invention is directed to a method for wrapping coiled material which includes the selection of a tear-resistant bag having openings at either end and drawstrings near each opening. A roll of steel is lifted by a forklift, or by other means, and the bag is slipped over the roll of steel. The excess material of the bag is then folded over so that the bag tightly fits the steel roll. The strings are then drawn tightly, pulling the bag radially over the steel roll such that the ends of the bag overlaps the aperture of the core of the roll. The overlapping portions of the bag is folded inside of the core of the coiled material and inner diameter protectors are placed in the core to secure the bag.

Accordingly, it is a principal object of the invention to present a method for quickly and easily wrapping steel or any other type of coiled material such that labor and the risk of accidents will be reduced.

It is another object of the invention to provide a method by which a roll of steel is completely covered such that it is protected from moisture.

It is a further object of the invention to provide a method for easily wrapping a steel roll.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
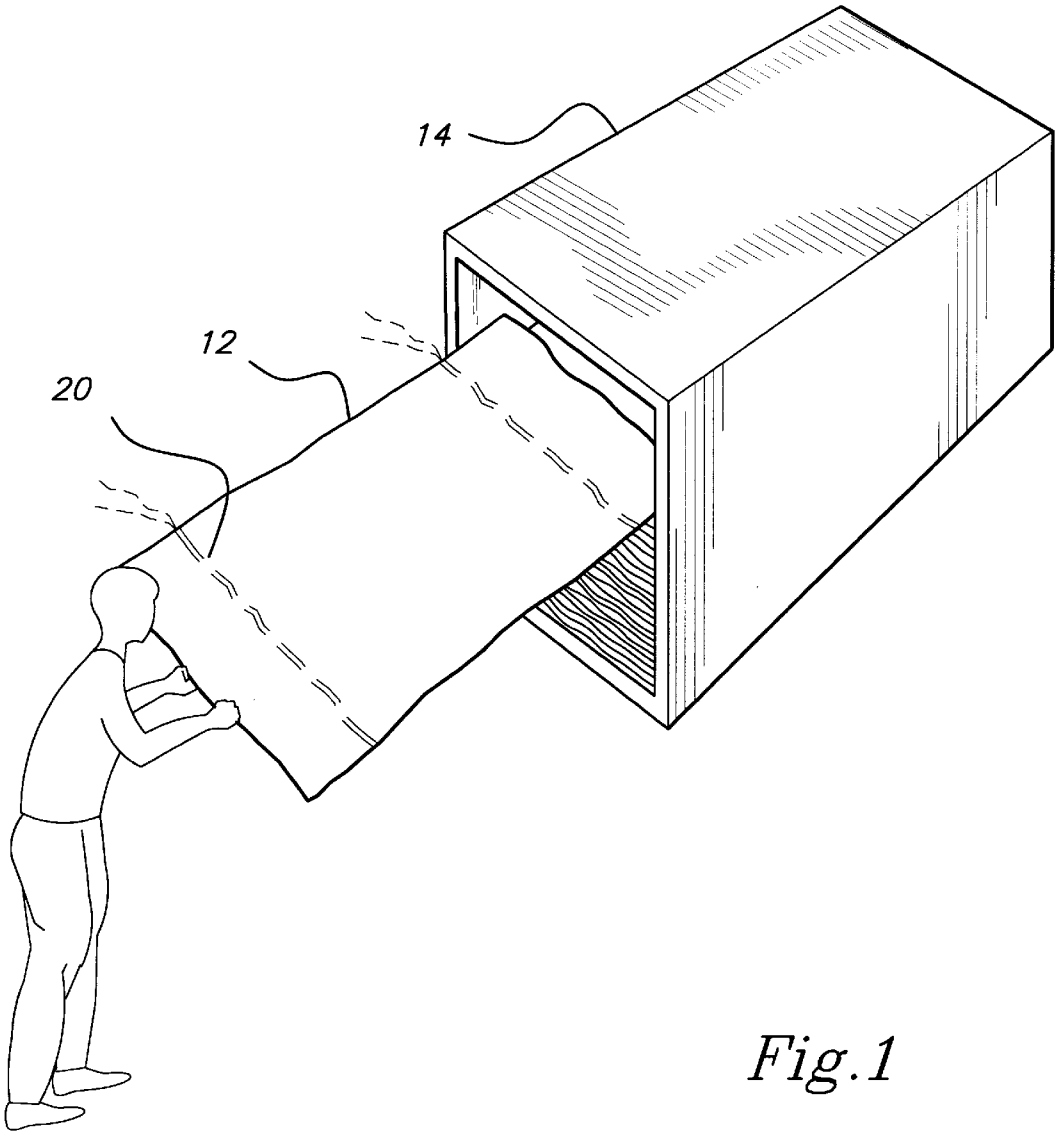
FIG. 1 is a perspective view of a plurality of preformed bags.

The present invention relates to a method for wrapping a roll of steel 10 in a tear-resistant tubular bag 12. As seen in FIG. 1, a tear-resistant bag 12, having openings at either end and drawstrings or ropes 20 near each opening, is selected from a storage container 14. It is to be understood that the strings or ropes 20 are an optional feature which facilitate the folding of the bag 12 about the roll of steel (discussed below) and may result in a more aesthetically-pleasing package.

Figure 2:
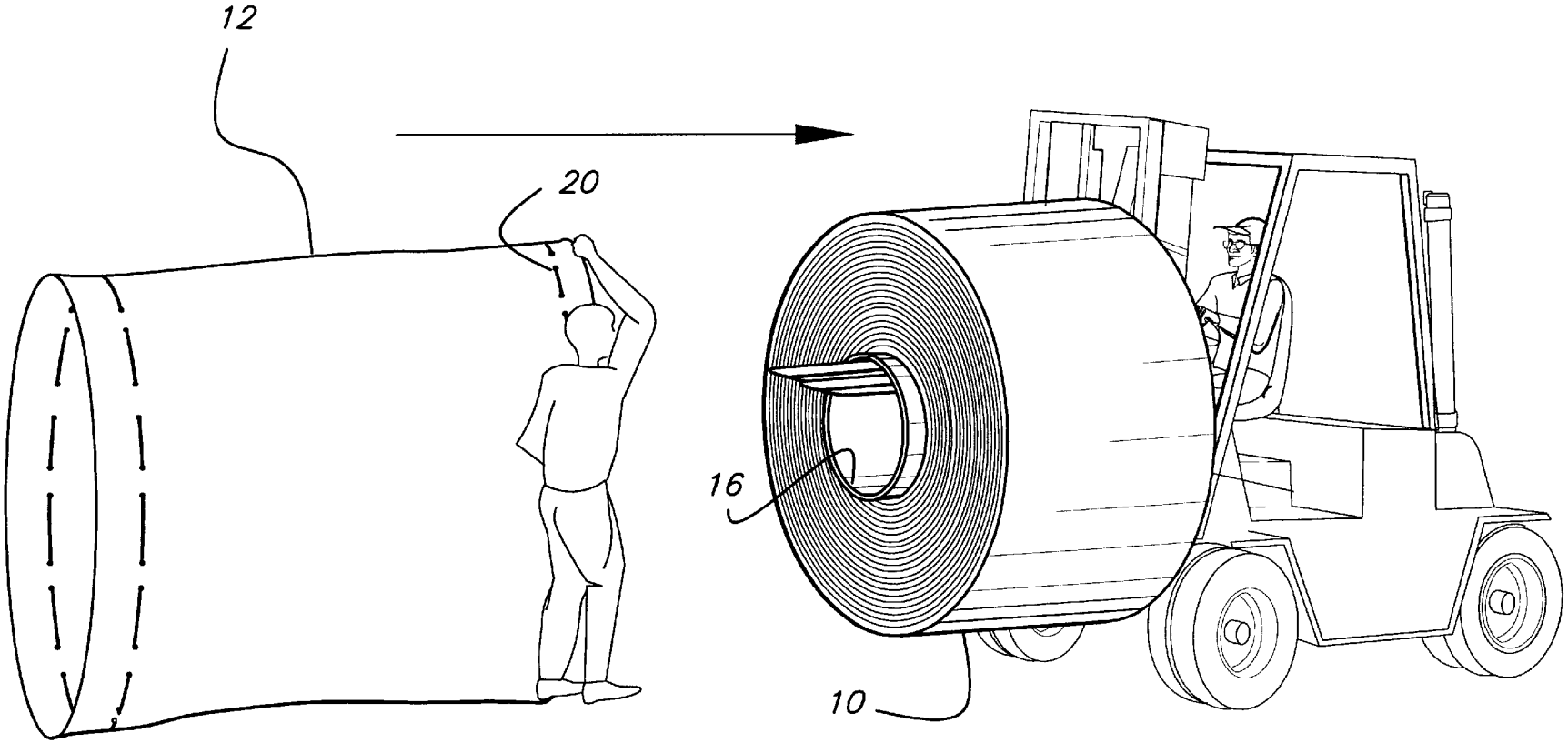
FIG. 2 is a perspective view of the preformed bag being placed over a raised roll of steel.

The bag 12 can be made from paper or plastic (polyethylene or polypropylene). The bag 12 has an opening, which is twice its width when folded, the size of which is greater than the periphery of the steel roll 10 so that the bag 12 may easily be slipped over a steel roll 10 when the roll 10 is raised by a forklift or other means, as shown in FIG. 2. A tube 16 is inserted through the central aperture of the steel roll 10 to evenly distribute the force of lifting about the inner periphery.

Figure 3:
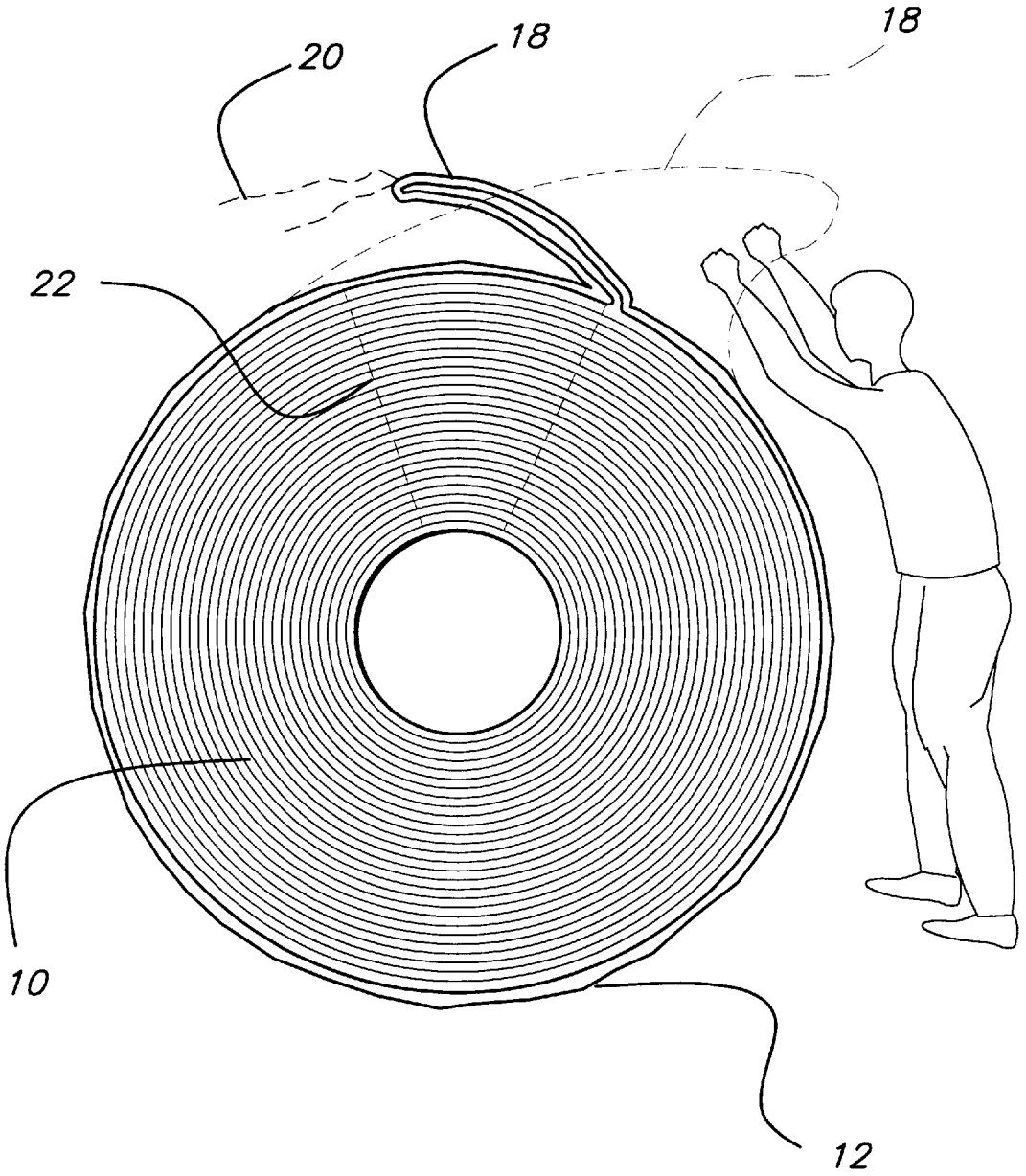
FIG. 3 is an elevational view of the preformed bag being folded around the roll of steel.

As discussed above, the bag 12 is larger than the steel roll 10 and there is excess material 18. The excess material 18 is pulled to a point above the steel roll 10 (as seen in the broken line showing of FIG. 3). The excess material 18 is then folded over to form an area 22 protected by three layers, i.e. an area of triple protection. When the roll 10 is later lifted by a forklift for transporting it, the area that undergoes the excess pressure due to the lifting in the triple protection area 22.

Figure 4:
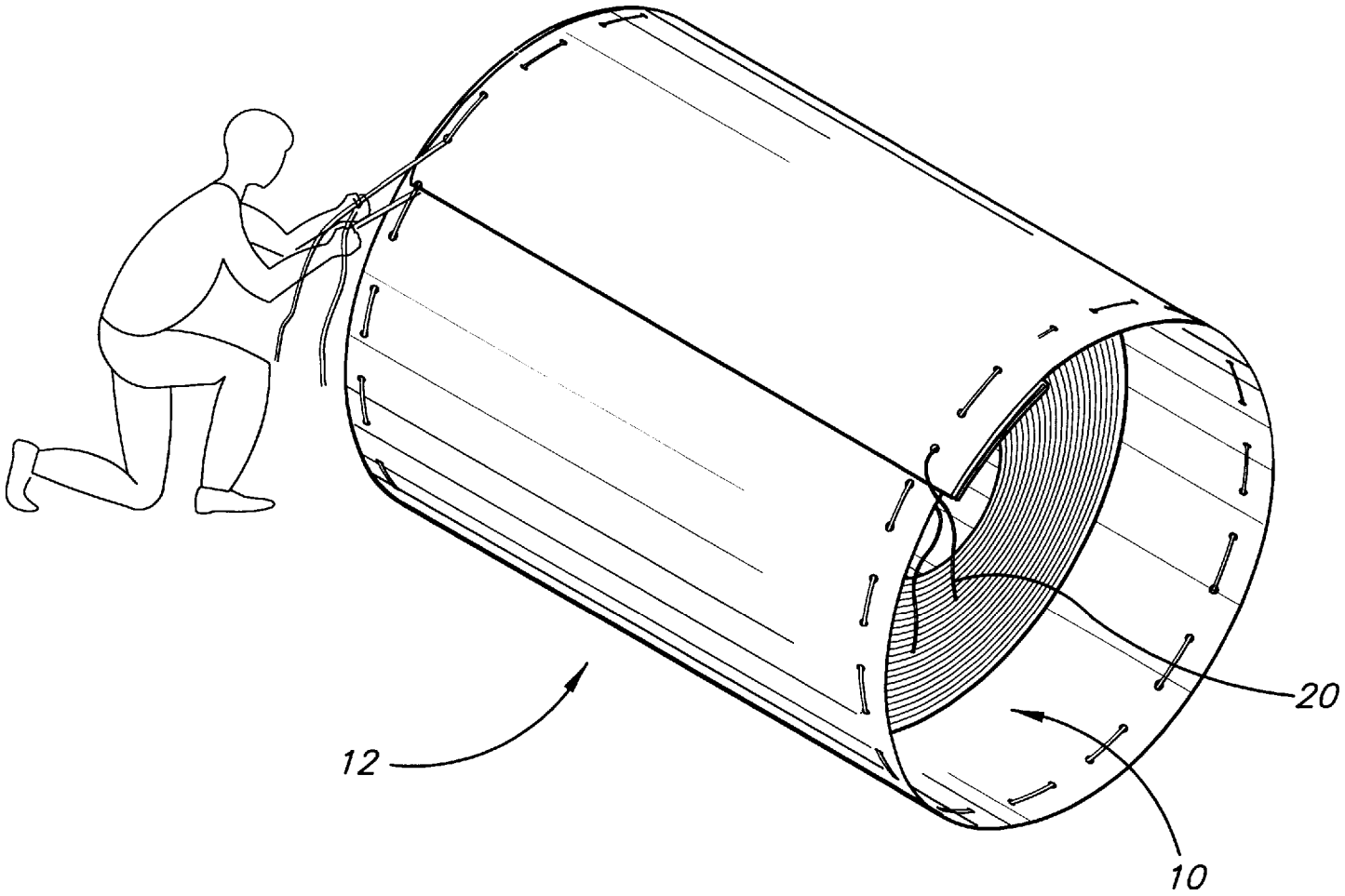
FIG. 4 is a perspective view of the bag being secured circumferentially around the steel.
Figure 5:
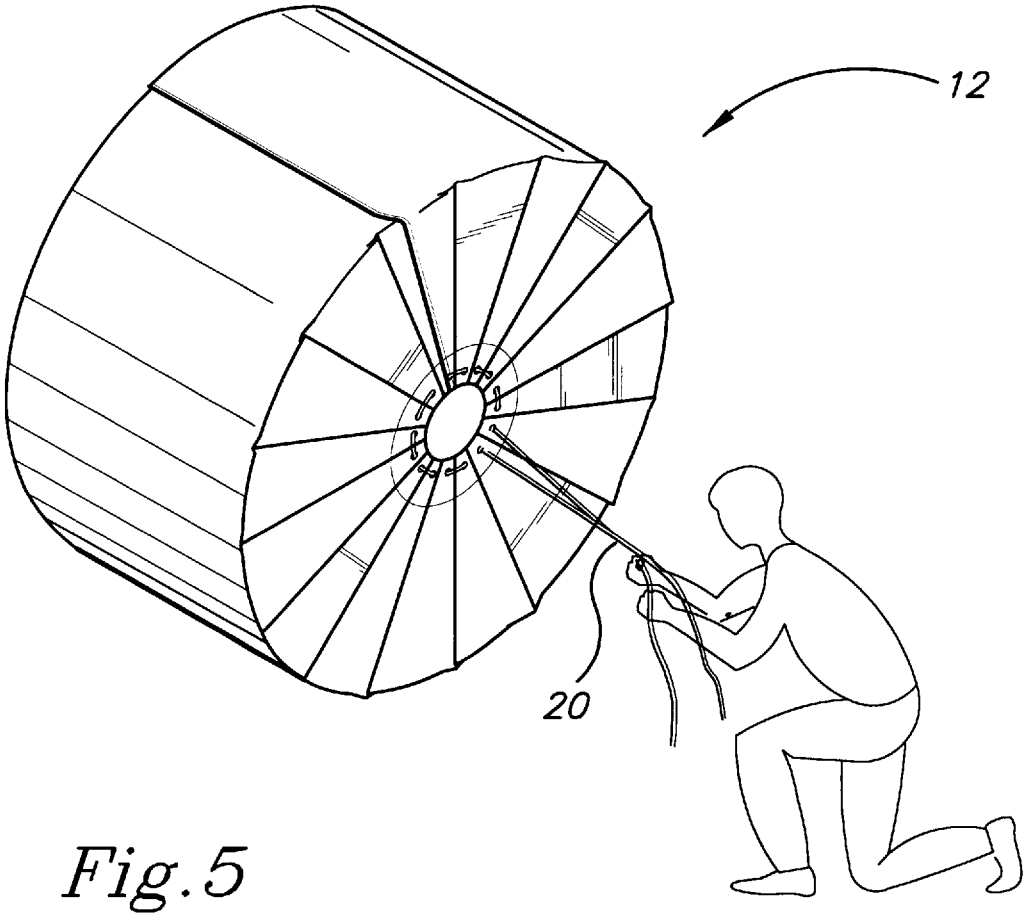
FIG. 5 is a perspective view of the bag being drawn radially along the roll of steel.
Figure 6:
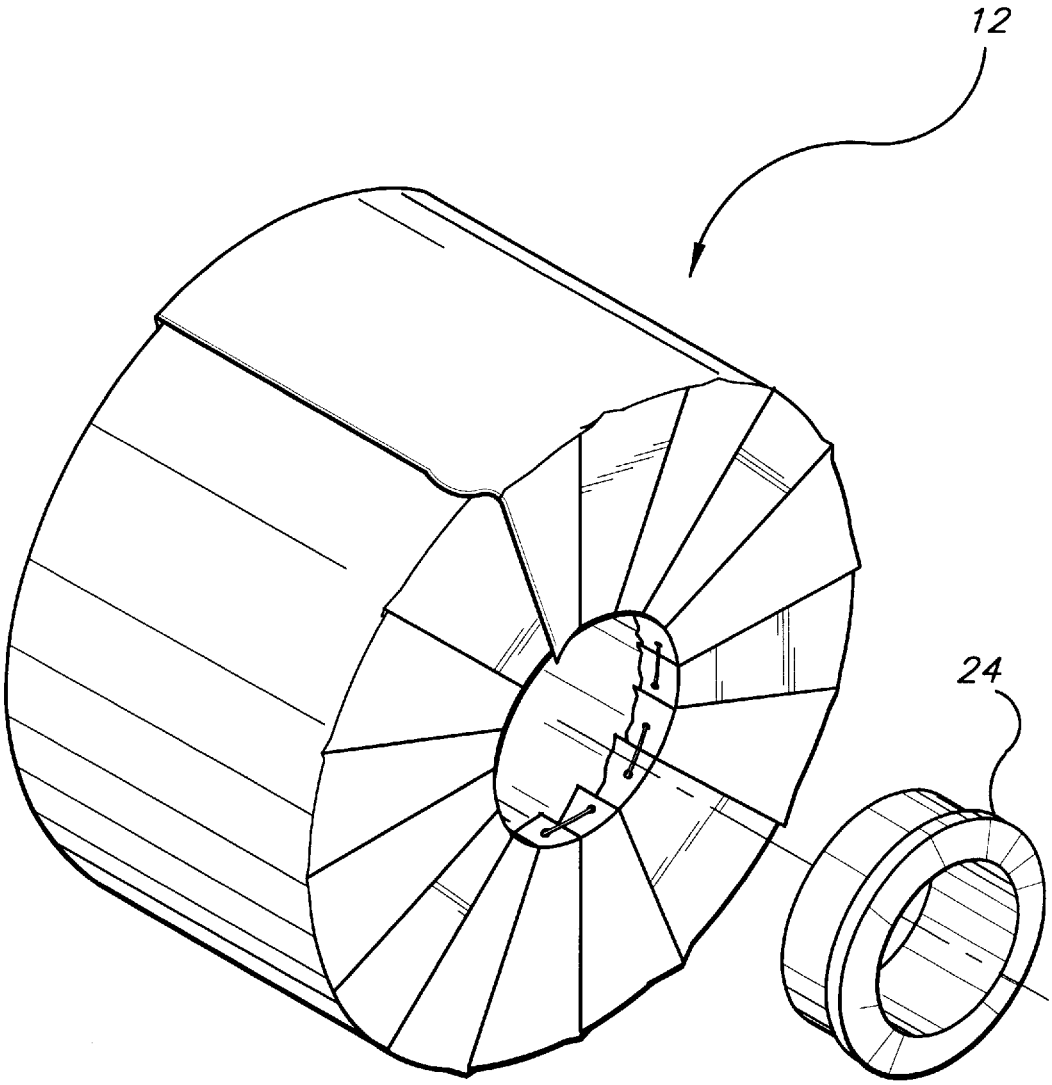
FIG. 6 is a perspective view of an inside diameter protector being inserted into the core of the steel.

The steel roll 10 is lowered by the forklift and the tube 16 is removed. The bag 12 is then pulled tightly around the steel roll 10 by the string or rope 20 running near the openings of the bag 12. This step is shown in FIG. 4. FIG. 5 shows the pulling of the bag 12, which is longer than the steel roll 10, such that the bag 12 overlaps the interior diameter of the steel roll 10. In the event that there is no string rope used, the bag is pulled and creased over the roll to accomplish the tasks shown in FIGS. 4 and 5. Finally, as shown in FIG. 6, this overlapping material is folded into the core of the steel roll 10 and secured against the steel roll by an inside diameter protector 24, which fits snugly into the steel roll. The steps of FIGS. 5 and 6 are then repeated for the other side of the steel roll, i.e. rope or string 20 is pulled tightly and an inside diameter protector 24 is used on the other side of the steel roll 10.

The result of these steps is the complete coverage of the steel roll 10, thus reducing chances of corrosion. Treatment of the bag 12 with a corrosion-inhibiting compound may be desirable to further reduce the possibility of corrosion. The corrosion material is a VCI (volatile corrosion inhibitor) and may comprise sodium nitrate.

It is to be understood that the present invention is not limited to the sole embodiment described above, but encompasses any and all embodiments within the scope of the following claims.

I claim:

1. A method of wrapping a cylindrical roll of coiled material, the cylindrical roll having a length, a circumference, and an inside diameter defining an opening with an inner periphery, said method comprising:

selecting a preformed tubular bag having a circumference larger than the circumference of the cylindrical roll, an opening at each end thereof and drawstrings adjacent each end;

lifting the cylindrical roll;

placing the cylindrical roll inside of the bag, such that there is excess circumferential bag material;

folding the excess bag material onto the cylindrical roll;

pulling each of the drawstrings towards the center of the cylindrical roll, such that the bag radially comes together at each end to cover the cylindrical roll and to form a circular aperture of smaller diameter than the inside diameter of the cylindrical roll; and placing an inside diameter protector at each end of the cylindrical roll and forcing the portion of the bag at each end against the inner periphery of the cylindrical roll.

2. The method of claim 1 wherein the step of lifting the cylindrical roll is accomplished by inserting a tube into the opening defined by the inside diameter of the cylindrical roll and lifting the cylindrical roll with a forklift.

3. The method of claim 1 wherein said step of selecting a bag includes selecting a bag treated with a corrosion inhibitor.

4. A method of wrapping a cylindrical roll of coiled material having a circumference and an inside diameter defining an opening with an inner periphery, said method comprising:

selecting a preformed tubular bag having a circumference larger than the circumference of the cylindrical roll and an opening at each end thereof;

lifting the cylindrical roll;

placing the cylindrical roll inside of the bag, such that there is excess circumferential bag material;

folding the excess bag material onto the cylindrical roll;

urging the bag towards the center of each end of the cylindrical roll, such that the bag radially comes together to cover each end of the cylindrical roll and to form a circular aperture of smaller diameter than the inside diameter of the cylindrical roll; and placing an inside diameter protector at each end of the cylindrical roll and forcing the portion of the bag at each end against the inner periphery of the cylindrical roll.

5. The method of claim 4 wherein the step of lifting the cylindrical roll is accomplished by inserting a tube into the opening defined by the inside diameter of the cylindrical roll and lifting the cylindrical roll with a forklift.

6. The method of claim 4 wherein said step of selecting a bag includes selecting a bag treated with a corrosion inhibitor.

* * * * *